US005251555A

United States Patent [19]

Speicher

[11] Patent Number: 5,251,555

[45] Date of Patent: Oct. 12, 1993

[54] METHOD AND APPARATUS FOR SIMULTANEOUSLY FORMING A PLURALITY OF CHARACTERS ON THE SURFACE OF AN OBJECT

[75] Inventor: Edwin W. Speicher, Pittsburgh, Pa.

[73] Assignee: M. E. Cunningham Company, Ingomar, Pa.

[21] Appl. No.: 886,292

[22] Filed: May 21, 1992

Related U.S. Application Data

[63] Continuation of Ser. No. 792,438, Nov. 15, 1991, abandoned, which is a continuation of Ser. No. 562,737, Aug. 3, 1990, abandoned.

[51] Int. Cl.[5] ..... B41J 3/00

[52] U.S. Cl. ..... 101/93.04; 101/93.48

[58] Field of Search ..... 400/124; 101/93.04, 101/93.05, 93.48, 93.14

[56] References Cited

U.S. PATENT DOCUMENTS 4,446,789 5/1984 Matsumoto et al. ..... 101/93.04

4,736,679 4/1988 Kobeyn ..... 101/93.14

FOREIGN PATENT DOCUMENTS 2002694 2/1979 United Kingdom .

*Primary Examiner*—Edgar S. Burr

*Assistant Examiner*—Ren Yan

*Attorney, Agent, or Firm*—Stanley J. Price, Jr.

[57] ABSTRACT

The marking device has a housing supporting a marking head for movement longitudinally and laterally preselected amounts controlled by a pair of stepper motors. The marking head has a plurality of marking pins that are air actuated and controlled by appropriate solenoids. The marking device is arranged to move the head longitudinally in a raster pattern so that each of the pins is actuated to form a portion of a character upon longitudinal movement through a selected distance. The marking head is then moved to a parallel y axis and subsequently moved longitudinally in a reverse direction. During the movement in a reverse direction, all of the pins are actuated to form other portions of the characters in the array. With this arrangement, a plurality of characters are simultaneously formed by impressing dots on an object until the marking head moves forward and backward on different y axes to simultaneously form all of the characters in the array. Another embodiment discloses a marking head having pairs of longitudinal lines of pins which are arranged to form characters with a double line.

10 Claims, 5 Drawing Sheets

METHOD AND APPARATUS FOR SIMULTANEOUSLY FORMING A PLURALITY OF CHARACTERS ON THE SURFACE OF AN OBJECT

CROSS REFERENCE TO RELATED APPLICATIONS

This application is a continuation of copending application Ser. No. 792,438 filed on Nov. 15, 1991, now abandoned entitled "Method And Apparatus For Simultaneously Forming A Plurality Of Characters On The Surface Of An Object" a continuation of Ser. No. 562,737 filed on Aug. 3, 1990, now abandoned.

BACKGROUND OF THE INVENTION

1. Field of the Invention

This invention relates to a method and apparatus for marking an object by imprinting characters onto the surface of the object and more particularly to a method and apparatus for simultaneously forming a plurality of characters on the surface of an object by simultaneously imprinting indented dot portions of the selected characters to thus simultaneously form the plurality of characters.

2. Description of the Prior Art

U.S. Pat. No. 4,506,999 discloses apparatus for forming multi-character messages by striking the surface of an object with a plurality of marking pins. The pins are mounted in a head or housing and are selectively actuated to form portions of a single character and as the object is moved relative to the housing, additional characters are formed by the same pins. Programmable controls are disclosed to provide the desired sequence of characters.

U.S. Pat. No. 4,214,520 discloses an imprint marking device that includes a plurality of marking elements or characters carried on the peripheral surface of a marking wheel. The wheel is rotated to the selected character and is advanced into marking relation with the surface of the object. The marking device with the wheel is then moved laterally relative to the object and the wheel is rotated to another preselected character and is again moved against the surface of the object to form a sequential mark.

British Patent No. 2,002,694 discloses a programmable dot matrix type of engraver for impressing a selected size of alpha-numeric characters on a work piece. The engraver is computer controlled to provide selective continuous marking of the work piece. The engraving tool is supported on an arm which is movable on a carriage by a lead screw rotated by a stepping motor. The carriage is movably mounted on a horizontal arm which is in turn supported by a vertical column above a base on which the object to be marked is fixedly positioned. With this arrangement, the engraving tool is movable along the horizontal x axis and stepped vertically or at a 90° angle along the y axis. The engraving tool has a punch which is remotely controlled by control means to form the desired dot matrix character. The size of the character engraved is determined by the number of steps of the stepping motor between each point on the $7\times5$ matrix. The engraver is arranged to form all of the indentations for all of the characters along the first $x=1$ axis and is then stepped to the second $y=2$ axis. The punch then moves along the $y=2$ axis and forms the indentations along the $y=2$ axis for all of the characters. Thus it is necessary for the punch to travel the entire length of the x axis for all characters for each step of the y axis. In this manner, all of the characters are formed by sequential stepping of the punch along the y axis and raster movement along the x axis.

U.S. Pat. No. 3,814,227 discloses a printer using a matrix of printing elements that are arranged in a square configuration with the printing elements arranged to print alpha-numeric data in either a vertical or horizontal orientation by selecting a rectangular matrix from less than the full number of printing elements in the square matrix to permit selectively orientation of the printed data without mechanically reorienting the head. The printing matrix may print from either end of a selected rectangular print matrix in either a horizontal or vertical orientation to provide four possible orientations of the printed alpha-numeric data.

U.S. Pat. No. 4,428,692 discloses a high speed impact matrix printer for use with data processing systems and digital communication systems. The printer is a wire matrix printer with the print head having wires arranged as a column within a wire guide. The print head is stepped serially across a print record and the print wire drivers fire the print wires in accordance with character configuration information.

U.S. Pat. Nos. 4,591,279 and 4,652,156 disclose improved print type impact printers with the apparatus for moving the print head relative to the object to be marked to form the desired characters by forming dot type indentations in the surface of the object.

U.S. Pat. No. 4,848,942 discloses pin type marking devices for marking an arcuate surface with dot matrix characters.

Certain of the above prior art printers and engravers utilize the pins to form a single character and then progress, usually horizontally, to form a second character on the object being marked. Other prior art engravers sequentially form portions of each character and thereafter, in a "raster" type pattern, sequentially form other portions of all of the characters until all of the characters are formed. There is a need for an impact type printer which will simultaneously and separately form a plurality of characters with a plurality of pins and also selectively form characters of different dimensions.

SUMMARY OF THE INVENTION

This invention relates to apparatus for simultaneously marking a preselected array of characters on an object. The apparatus includes a housing and a marking device for imprinting a preselected array of characters on an object. The marking device is movably supported in the housing. Means are provided to movably support said marking device adjacent to said object to be marked. The marking device has a plurality of marking elements mounted on the marking device parallel to the longitudinal axis of the marking device. First means are provided to move the marking device linearly in a direction parallel to the longitudinal axis of the marking device along a preselected axis. Actuating means are provided to selectively actuate each of said marking elements along the preselected axis to mark portions of each of the preselected array of characters. A second means is provided to move the marking device and the marking elements to a second parallel axis so that the first means moves the marking device and the actuating means actuates the marking elements on the second axis to mark other portions of the preselected array of characters.

The invention also includes a method for simultaneously marking a preselected array of characters on an object and includes the steps of movably positioning a marking device for imprinting preselected characters of a preselected array of characters adjacent to the object to be marked. The marking device is moved linearly in a direction parallel to the longitudinal axis of the marking device along a first axis. A plurality of marking elements are mounted on the marking device parallel to the longitudinal axis of the marking device and are selectively actuated while the marking device is moving along the first axis to mark portions of each of the characters of the selected array of characters on an object. The marking device is then moved perpendicular to a second axis and the marking elements are again selectively actuated while the marking device is moved along the second axis to mark other portions of the preselected array of characters on an object.

It is the principal object of this invention to provide a method and apparatus for simultaneously marking portions of each character of an array of characters while moving the marking head longitudinally in one direction.

Another object of this invention is to provide a marking head that moves in a raster pattern while the marking elements are marking portions of each of the characters while the marking head is moving linearly in a selected direction.

A further object of this invention is to provide an apparatus for simultaneously marking a preselected array of characters in which the spacing between the marking elements may be changed to provide characters of a different size.

These and other objects of the invention will become more apparent from the accompanying drawings, specification and appended claims.

DESCRIPTION OF THE DRAWINGS

FIG. 4 only illustrates a portion of the array of characters and is intended to only illustrate the raster movement of one of the marker pins.

FIG. 5(*a*) illustrates the marking head or device after completion of two passes. FIG. 5(*b*) illustrates the marking head after making three additional passes. FIG. 5(*c*) illustrates the marking head or device after it has made four additional passes and completes the array of characters comprising letters A through I.

FIG. 11 is a fragmentary view of the array of characters illustrated in FIG. 9.

DESCRIPTION OF THE PREFERRED EMBODIMENTS

Figure 1:
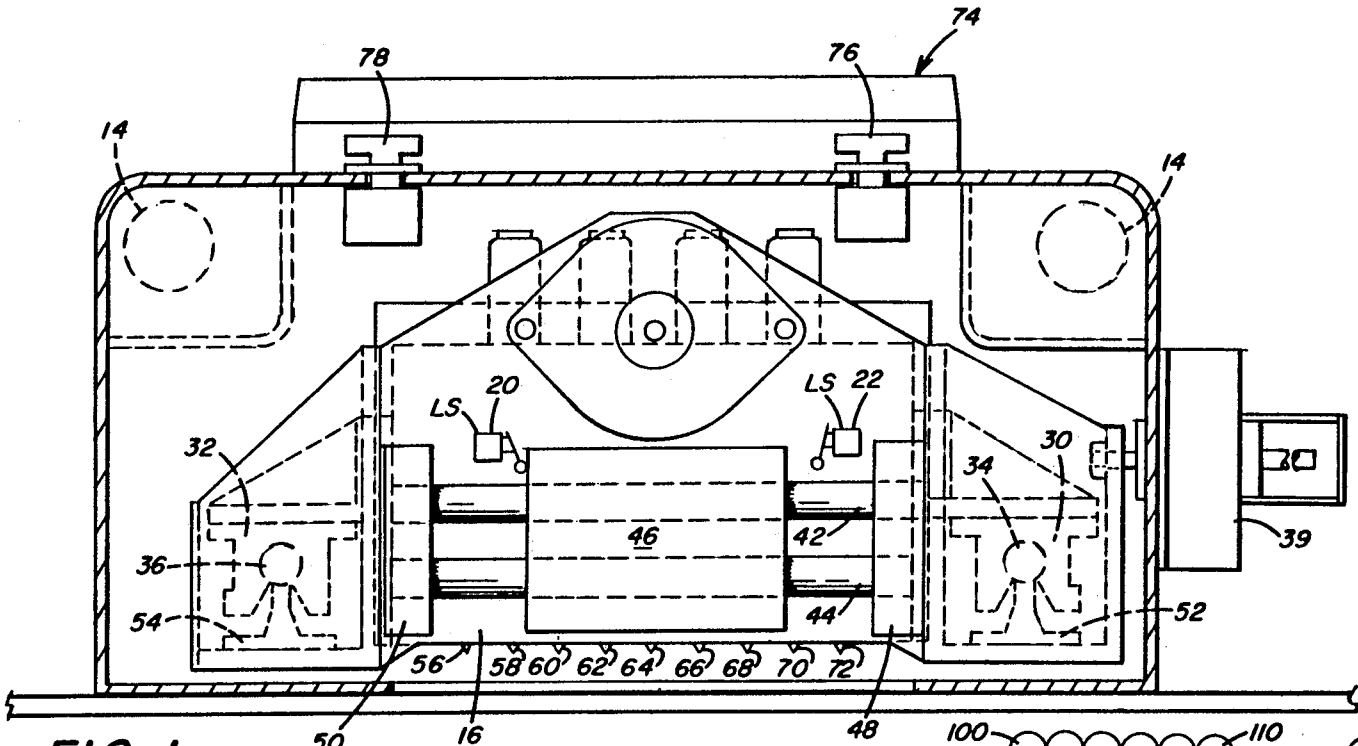
FIG. 1 is a view in front elevation and partially in section illustrating the apparatus for supporting the marking head and for moving the marking head along an axis during the marking of an array of characters on an object.
Figure 2:
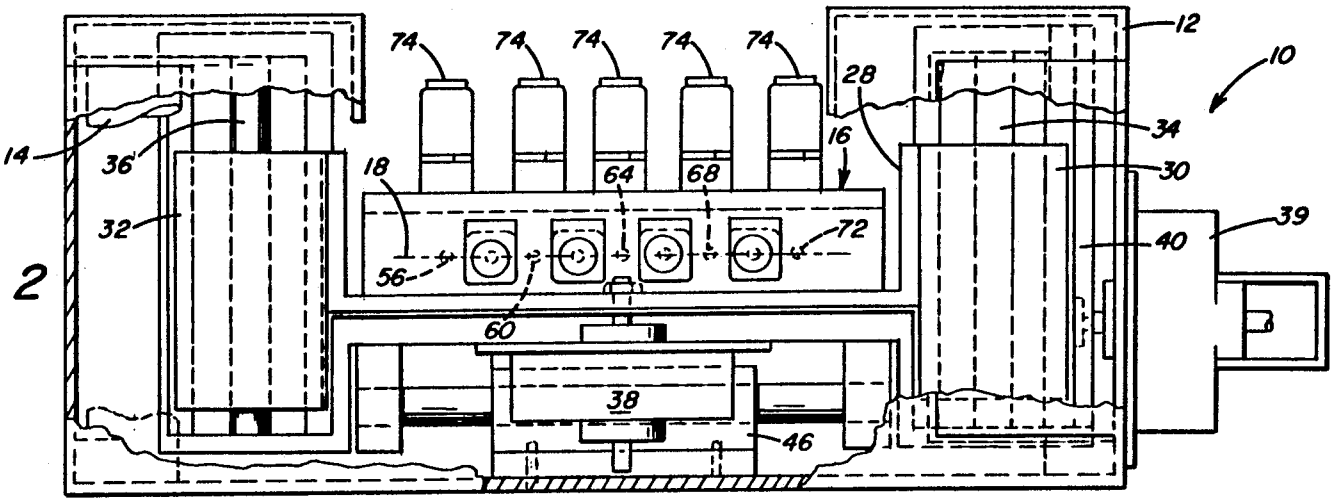
FIG. 2 is a top plan view with a portion of the housing removed to illustrate the apparatus for moving the marking device along a second axis.
Figure 3:
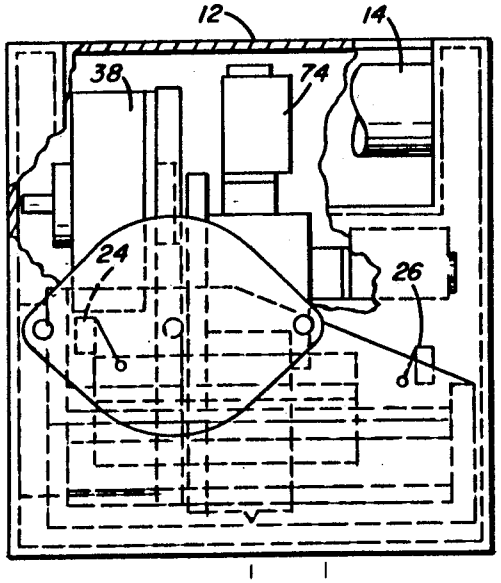
FIG. 3 is a view in side elevation with portions of the housing broken away to illustrate the manner in which the marking device is mounted and supported within the housing.

Referring to FIGS. 1, 2 and 3, there is illustrated a hand held marker unit generally designated by the numeral 10. The hand held marker unit includes a frame or housing 12 with a pair of cylindrically shaped handles 14 partially illustrated in FIGS. 2 and 3 and illustrated in dotted lines in FIG. 1. The handles are arranged to permit manual positioning of a hand held marker unit with the operator holding the marker unit during the marking operation. It should be understood, however, that the unit may be clamped to the object to be marked or held against the object by the operator.

A marking head, generally designated by the numeral 16, is movably supported within the housing 12 and is arranged to move laterally along an axis parallel to the longitudinal axis 18 of the marking head 16 illustrated in FIG. 2. The window or distance the marking head 16 moves along the first axis is limited by the limit switches 20 and 22. The marking head 16 is also arranged to move along axes parallel to the marking head longitudinal axis and other limit switches 24 and 26, illustrated schematically in FIG. 3, limit the window for the vertical movement of the marking head 16. Throughout the specification, the horizontal axis will be designated as the x axis parallel to the longitudinal axis 18 of marking head 16, the movement distance of which is controlled by limit switches 20 and 22.

The perpendicular axis will be designated by the y axis perpendicular to the longitudinal axis 18 of head 16. The first axis in a dot matrix system is along a x axis and the perpendicular axis is along a y axis.

The marking head 16 is secured to a bracket 28. The bracket 28 is in turn connected at its opposite ends to roller bearing supports or bearing ways 30 and 32. The roller bearing supports are mounted on shafts 34 and 36 and permit the marking head, bracket and supports to move along a vertical axis to incrementally move the marking head to the next x axis during the marking operation. A stepper motor 38 is connected to the head 16 and is arranged to incrementally move the head 16 by means of a screw drive.

A second stepper motor 39 is connected to a support 40 for the head 16 and is arranged to move the head 16 on the cylindrical shafts 42 and 44. The marking head 16 has a portion 46 which has ball bearing ways therein to permit the head 16 to move along the x axis as illustrated in FIG. 1. The shafts 42 and 44 are supported in brackets 48 and 50.

The cylindrical shafts 34 and 36 are supported on brackets 52 and 54 and the marking head support member has the previously described bearing ways 30 and 32 suitably supported on the shafts 34 and 36.

With this arrangement, the stepping motors 38 and 39 are arranged through screw drives to incrementally move the marking head from one x axis to the next adjacent x axis and to incrementally move the marking head along the selected x axis and to stop and permit the nine punches or pins designated by the numerals 56–72 to indent or impress a dot mark on the object to be marked where a mark is desired for a particular character of the array.

The marking head 16 has a plurality of solenoids 74, one for each of the pins, and the solenoids control a source of air under pressure and are actuated by a suitable control means such as a computer or the like (not shown) to selectively actuate the pins 56–72 where appropriate to apply a dot by first stopping the head 16 and then having the pin strike the object and indent the object to form one of the dots of the character being marked.

The marking head, illustrated in FIGS. 1–3, is similar to the marking head described and illustrated in U.S. Pat. No. 4,652,156 assigned to the present assignee, and this patent is incorporated herein by reference. Suitable control means such as a computer is connected through a keyboard and readout device generally designated by the numeral 75 in FIG. 1. The keyboard and readout device may be a device such as a Model TM8500 keyboard as manufactured and sold by Burr-Brown Company. There is also provided a return regulator 76 and an input regulator 78. Suitable programs are provided for the computer to permit the preselected array of characters to be formed by the pins 56–72 on the object to be marked.

The size of the characters and the spacing of the characters may also be changed. For example, the marking device is capable of producing three lines of ¼ inch characters with each line having a maximum of eighteen characters. The unit can also produce two lines of ⅜ inch characters having a maximum of eighteen characters. The marking head 16 can be modified to position the pin centers at ⅝th of an inch and it is possible with this marking head to mark nine ½ inch characters. The dot matrix of the ½ inch characters is, however, more than the dot matrix of the ¼ inch characters. For example, the ¼ inch characters have a 7×9 matrix where the ½ inch characters have a 14×18 matrix. It is also possible, through suitable programming, to provide a program where the print head 16 will simultaneously print an array of every other character and then move one-half the distance between the pins and thereafter, print the second even numbered characters of the array.

Figure 4:
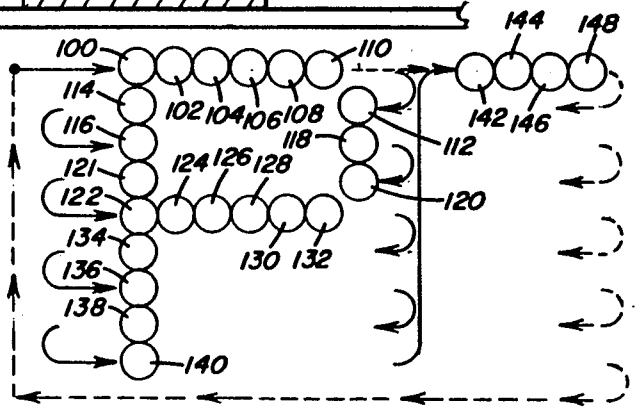
FIG. 4 is a fragmentary diagrammatic view illustrating the manner in which the marking head moves back and forth in a raster pattern along an axis at different locations along a second axis to the plurality of characters in the array of characters.

Referring first to FIG. 4, there is illustrated for a single character, the path followed by a single pin during the raster movement of the head 16 and the downward movement of the head as illustrated in FIG. 4 to form the respective letter. It should be understood that FIG. 4 merely illustrates the path followed for the head 16 for a single pin such as pin 56. As later described and illustrated, the movement of the entire head to simultaneously form a plurality of characters in the same manner will be described with reference to FIG. 5.

Referring to FIG. 4, the manner in which characters are imprinted by movement of the printing head and one of the printing pins is illustrated. The printing head, as previously discussed, is arranged to move along the x or horizontal axis in this illustration seven increments and is arranged to move along the y axis or vertically nine increments.

As illustrated, one of the pins to form the letter "P" is arranged for the pin to move to the top vertical increment on the Y axis and moves into position on the first lateral increment on the X axis to location 100. The program actuates the pin to strike the object being marked at this location to form an indentation 100. The carrier then moves laterally to the right on the x axis and sequentially indent marks 102, 104, 106, 108 and 110. This forms the upper horizontal line of the programmed letter "P" for the particular pin. The carrier then moves downwardly on the y axis one increment and is actuated to form impression 112 in the device to be marked. The pin carrier then moves laterally five increments along the x axis and during this movement, the pin is not actuated. When the pin moves through these five increments to the sixth increment directly below the mark 100, the head 16 is stopped and the pin is actuated to form indentation 114. The head is then moved downwardly one increment and the pin is actuated to form indentation 116. The carrier then travels horizontally along the x axis and is not actuated for five increments and is then actuated on the sixth increment to form indentation 118. The carrier then moves the pin on the y axis to the next lower increment or x axis and is actuated to form identation 120. The carrier then moves laterally on the x axis and the pin is programmed so that it is not actuated for five increments and is then actuated at the sixth increment to form indentation 120. The carrier is then moved downwardly one increment to the next x axis and is actuated for the next six increments to form the indentations 122, 124, 126, 128, 130 and 132. The carrier is then programmed to move to the next x axis or horizontal increment and is not actuated. The carrier then moves downwardly to the next x axis or horizontal increment and is programmed to move laterally through six increments without being actuated. On the seventh increment it is actuated to form indentation 134.

The carrier is then moved downwardly one increment on the y axis and the pin is actuated to form indentation 136. The carrier then moves horizontally through six increments without the pin being actuated and at the end of the horizontal movement is moved downwardly another increment without the pin being actuated and is moved six increments laterally as indicated by the arrow and is actuated to form indentation 138. The carrier is then moved downwardly to the next horizontal increment and the pin is actuated to form indentation 140 and thereafter the pin is not actuated through the next six increments.

With this arrangement, the letter "P" may be formed. As the letter "P" is being formed, all of the letters of the array of characters are also being formed so that when the letter "P" is complete the entire array of characters is complete. Where desired to print every other character after the array of characters that include the letter "P" is complete, the head is moved one-half the distance between the pins and a second array of characters may be printed. This is diagrammatically illustrated by the dots 142, 144, 146 and 148. The carrier is then arranged to move downwardly one increment at a time and the pin is actuated to form the desired character as provided by the data processor or computer.

It should be understood, that two or more letters or numerals may be formed by permitting the carrier to progress along the top increment more than the seven spaces provided for the letter "P" as previously described. The carrier may be programmed to continue horizontally along the top increment, as for example, after forming indentation 110 to continue to form indentations 142 through 148. This, however, requires a wider window to permit the head to traverse, in one stroke, the length of two letters.

The head or carrier may be sized to form different sized characters, as for example, ⅛ inch characters or ⅜ inch characters or ½ inch characters.

Figure 5:
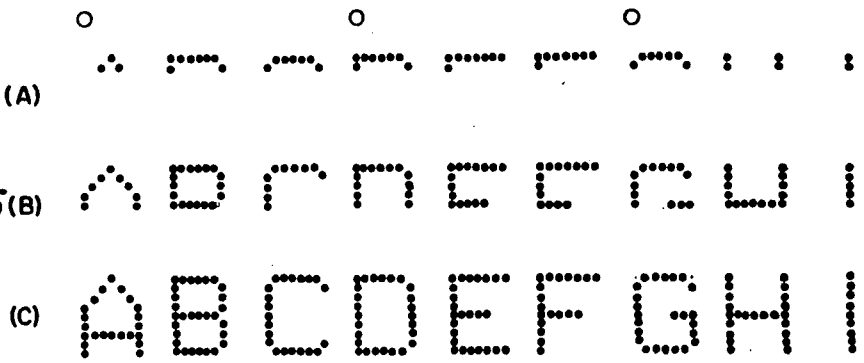
FIGS. 5(*a*), (*b*) and (*c*) are a diagrammatic illustration on how the array of characters are formed by the raster movement of the marking device.

Referring to FIGS. 5(*a*), (*b*) and (*c*), there is diagrammatically illustrated how the array of characters A through I are simultaneously printed. FIG. 5(*a*) illustrates the marking head 16 moving in a raster pattern through one pass from left to right and the second pass from right to left. FIG. 5(*b*) illustrates the marking head making three additional passes from left to right, then right to left and left to right in a raster pattern along adjacent y axes of the dot matrix. FIG. 5(*c*) illustrates the marking head making four additional passes along four different y axes in a raster pattern to complete the characters A through I in the array. It will be apparent from the FIGS. 5(*a*), (*b*) and (*c*), that portions of all of the characters A through I are simultaneously being formed by the raster movement of the marking head 16.

It should be understood that other simultaneously forming of characters may be accomplished by suitable programming, as for example, simultaneously forming every other character and then moving the head a distance of one-half of the distance between the marking pins and thereafter forming the intermediate characters between the formed characters. It should also be understood that a plurality of lines of characters may also be formed by appropriately selecting and programming the actuation of the respective stepper motors 38 and 39 and the respective solenoids 74.

EMBODIMENT OF FIGURES 6–11

Referring to FIGS. 6–11, there is illustrated another embodiment of a marking device generally designated by the numeral 200. With this embodiment, the marking device is capable of forming large sized letters that can generate characters of a size of about 3×1½. Each character is arranged to use two pins to make portions of each character.

Figure 6:
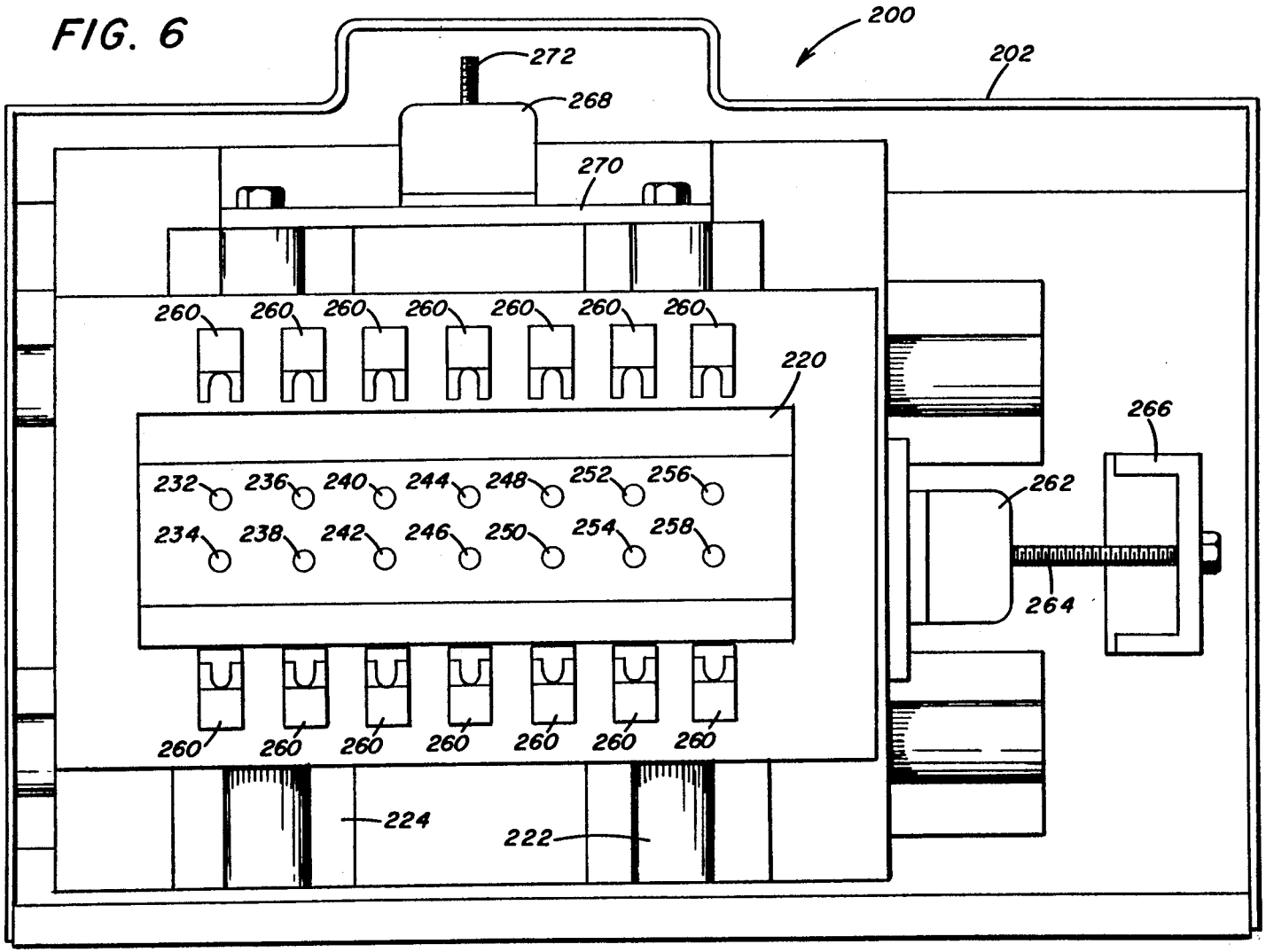
FIG. 6 is a top plan view of another embodiment of the marking apparatus in which a pair of marking pins are utilized to form double lined letters.
Figure 7:
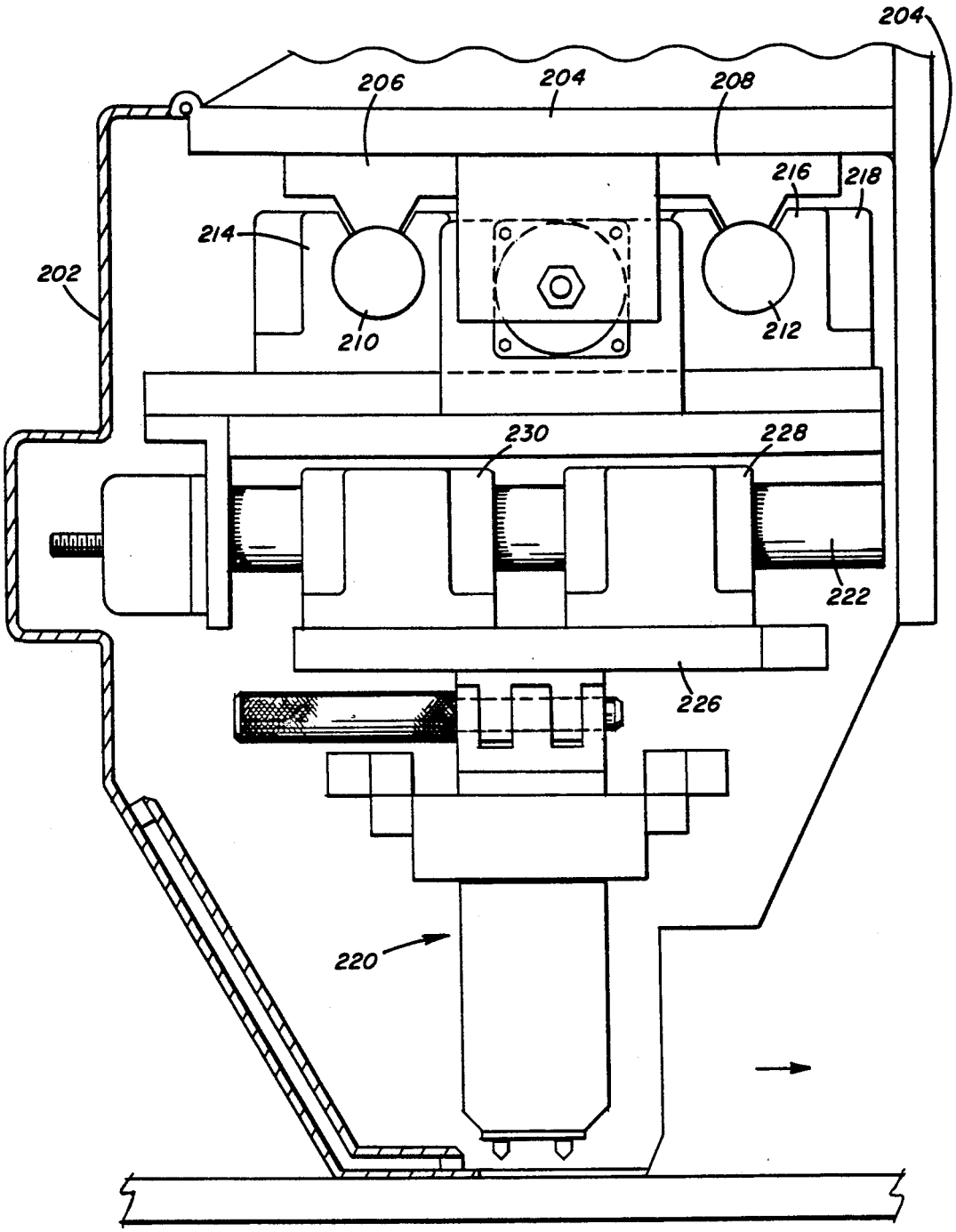
FIG. 7 is a view in side elevation with portions broken away illustrating the manner in which the marking head is supported within the housing.
Figure 8:
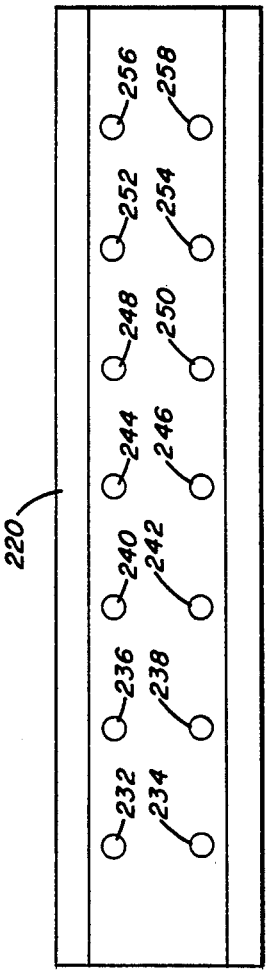
FIG. 8 is a view of the underside of the marking head illustrating the arrangement of the sixteen marking pins.

Referring to FIGS. 6, 7 and 8, the marking device 200 has a housing 202 arranged to be moved in abutting relation with the object to be marked. This marking device is particularly suitable for use in marking billets or the like where identification from a substantial distance is required.

Positioned within the housing 202 is a bracket member 204 which has a pair of support members 206 and 208 depending therefrom. The support members 206 and 208 have cylindrical members 210 and 212 which are positioned in ball bearing ways 214 and 216 which form a part of a subframe 218. The subframe supports a marking head generally designated by the numeral 220. The subframe 218 has a pair of cylindrical support rods 222 and 224. The marking head 220 is attached to a bracket 226 that has a pair of roller bearing ways 228 and 230. The marking head 220, as illustrated in FIG. 2, is connected to the bracket 226 which in turn is supported by the roller bearing ways 228 and 230 on the cylindrical support rods 222 and 224.

The marking head 220 is in many respects similar to the marking head 16 illustrated in the first embodiment. The marking head as illustrated in FIG. 6 has seven pairs of pins or punches 232–258 mounted in the head 220. The pins are arranged in two longitudinal lines spaced from each other preselected longitudinal and lateral distances. Each of the pins is actuated by air under pressure and each is controlled by a solenoid 260 so that each of the pins can be selectively actuated to fire and form an indentation or mark in the surface of the object to be marked.

Figure 10:
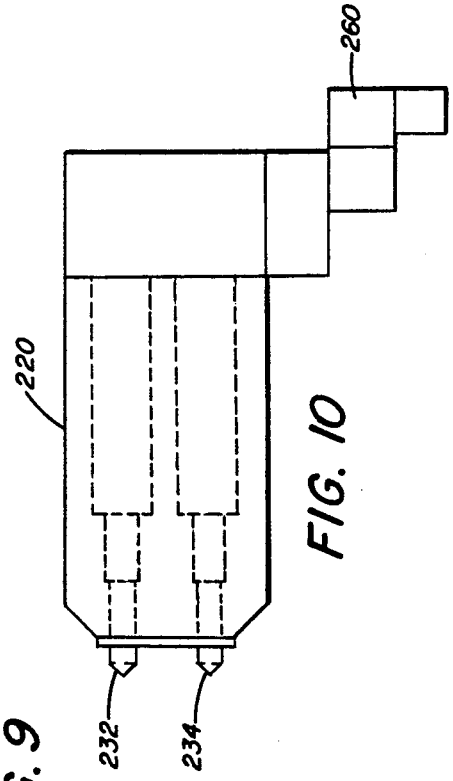
FIG. 10 is a view in side elevation of the marking head with a pair of parallel pins extending thereform.

The underside of the marking head 220 is illustrated in FIG. 8 showing the longitudinal and lateral alignment of the pins. As described with the previous embodiment, the marking head is arranged to move longitudinally along the longitudinal axis of the head 220 and also arranged to move laterally along the opposite axis. FIG. 10 further illustrates the pins, as for example pins 232 and 234 mounted in the marking head 220 with the solenoid 260 diagrammatically illustrated.

The longitudinal movement of the marking head 220 is controlled by a stepping motor 262 that has a screw drive 264 bolted to a support 266. Actuation of the stepping motor 262 moves the marking head 220 along its longitudinal axis in step fashion which is controlled by a computer to provide the appropriate location for the respective pin 232–258 when one or more of the pins are actuated to form an impression or dot on the object being marked.

A second stepper motor 268 is attached to a bracket 270 associated with the marking head 220 and has a screw drive 272. The stepper motor 268 is arranged to rotate the screw drive 272 to incrementally move the marking head to different locations along the longitudinal axis of the marking head 220. Again, computer controlled signals are provided to the stepper motors 268 and also to the solenoids 260 to position the pins along preselected x axis and to actuate the pins as the stepper motor 262 moves the head laterally to sequential y axes. It should be understood that suitable limit switches are provided with the embodiment illustrated in FIGS. 6–11 to limit both the longitudinal and lateral movement of the marking head 220.

Figure 9:
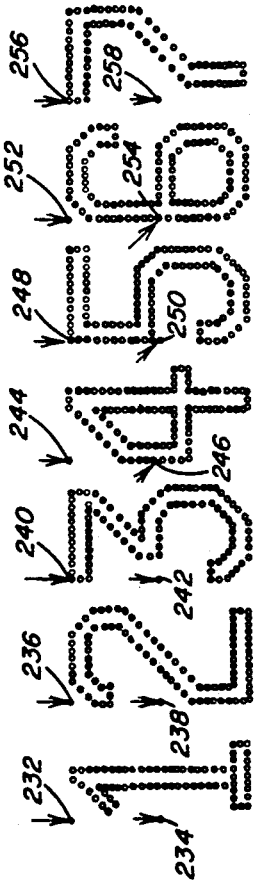
FIG. 9 is an illustration of the double lined numerals 1–7 formed by the marking head illustrated in FIGS. 6 and 7.

FIG. 9 illustrates an array of seven numerals which may be formed simultaneously with the marking head moving through a distance limited to the dot matrix configuration for the numeral.

The pins are identified in FIG. 9 by the dots with the arrow connected thereto. In forming the numerals 1–7, as illustrated in FIG. 8, the marking head 220 is positioned at the location illustrated in FIG. 9. The marking head is then moved longitudinally from right to left and all of the pins 232–258 are actuated to form portions of the respective numerals. It should be noted, however, that the upper half of each numeral is formed by the upper line of pins 232, 236, 240, 244, 248, 252 and 256. The lower half of each numeral formed by dots or impressions made by the pins 234, 238, 242, 246, 250, 254 and 258. Thus, with one singular longitudinal movement of the marking head 220, all of the pins are actuated at appropriate times to provide the appropriate dots and simultaneously form all of the characters, in this instance numerals 1–7, in one movement of the head 220. It should be understood, however, within the preselected window, the head 220 follows a raster pattern where the head 220 is moved laterally on a selected y axis and reciprocated on different x axes to form the preselected characters.

Figure 11:
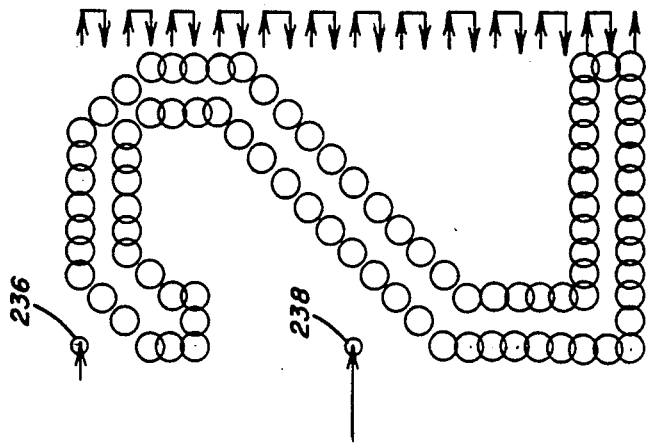
FIG. 11 is a diagrammatic view illustrating the path of a pair of pins forming the numeral "2".

FIG. 11 illustrates that raster pattern for a single numeral, i.e. the numeral 2 illustrated in FIG. 9, and the movement of the pins 236 and 238 move longitudinally to the right, as viewed in FIG. 11, along the first x axis. The pin 236 forms the seven dots for the upper line of the numeral 2 and simultaneously, the pin 238 on another x axis spaced therebelow, forms two spaced dots for the intermediate portion of the numeral 2. The marking head is then moved laterally to the next x axis where the pins 236 and 238 move in a reverse direction and form the dots on the object to form other portions of the numeral 2. The raster pattern with incremental movement to different x axes and the actuation of the pins 236 and 238 at appropriate locations form the numeral 2 by the plurality of dots in the dot matrix.

It should be understood that other variations in the number of dots simultaneously formed for each separate character may be made without departing from the scope of the invention.

The simultaneous forming a plurality of characters in an array by means of the raster movement of the marking heads 16 and 220 now provide apparatus in which the speed of marking in a dot matrix fashion can be substantially reduced and the size of the apparatus to perform the marking operation can also be substantially reduced with reduced cost and where desired portability. Apparatus can also generate multiple lines of characters utilizing the same raster movement of the marking head. It should also be understood that the number of pins both longitudinally and laterally can be increased or decreased so that the size of the characters can be appropriately changed.

According to the patent statutes, I have explained the principle, preferred construction and mode of operation of my invention and have illustrated and described what I now consider to represent its best embodiments. However, it should be understood that within the scope of the appended claims, the invention may be practiced otherwise than as specifically illustrated and described.

I claim:

1. Apparatus for simultaneously marking a preselected array of characters on an object comprising, a housing, a marking device for imprinting a preselected array of characters on an object, said marking device having a longitudinal axis, support means for movably supporting said marking device within said housing to move said marking device incrementally along a pair of intersecting axes adjacent to said object to be marked, said marking device having a plurality of marking elements positioned in spaced relation to form a linear array for simultaneously marking the object with a preselected number of characters at preselected positions in a linear array where the number of marking elements on said marking device is less than the maximum number of characters to be marked in the linear array, said array of marking elements being positioned to extend on a preselected axis spaced apart a distance greater than the distance between characters in the linear array, said preselected axis of said marking elements being positioned parallel to said longitudinal axis of said marking device, first means for linearly moving said support means in a direction parallel to said longitudinal axis of said marking device along a preselected first axis for marking, said preselected axis of said marking elements being aligned with said preselected first axis for marking, said first means for moving said marking device including control means drivingly connected to said marking device for incrementally moving said marking elements to selected positions along said first axis for marking more characters in a linear array on the object than the number of said marking elements on said marking device, actuating means positioned on said marking device for selectively actuating said marking elements to strike the object and simultaneously mark said object with portions of each of said preselected array of characters on said first axis for marking, said actuating means provided for each of said marking elements and movable therewith, second means for moving said marking device and marking elements on said support means relative to the object to be marked to a second axis for marking, said first and second axes for marking being parallel, and said first means for moving said marking device and said actuating means actuates said marking elements on said second axis for simultaneously marking the object with other portions of each of the characters of said preselected array of characters.

2. Apparatus for simultaneously marking a preselected array of characters as set forth in claim 1 in which, said marking device being movable along an x axis parallel to the longitudinal axis of the marking device, said second means for moving said marking device is arranged to move said marking device in a direction perpendicular to said marking device longitudinal axis along a y axis.

3. Apparatus for simultaneously marking a preselected array of characters as set forth in claim 1 in which, said first and second means being connected to said marking elements to move said marking elements in a raster pattern incrementally on successive x axes parallel to the longitudinal axis of said marking device to mark successive portions of said preselected array of characters.

4. Apparatus for simultaneously marking a preselected array of characters as set forth in claim 1 in which, said actuating means arranged to actuate said marking elements so that each of said marking elements simultaneously forms a preselected portion of one of said characters in said preselected array of characters.

5. Apparatus for simultaneously marking a preselected array of characters on an object as set forth in claim 1 which includes, stop means for limiting the linear movement of said marking device along said preselected axis.

6. Apparatus for simultaneously marking a preselected array of characters on an object as set forth in claim 5 in which, said stop means limits the distance said marking device moves along said preselected axis during the forming of said preselected array of characters.

7. A method for simultaneously marking a preselected array of characters on an object comprising, movably positioning a marking device on a pair of intersecting axes adjacent to the object to be marked holding the object to be marked fixed relative to the marking device, mounting a plurality of marking elements for imprinting a preselected array of characters in spaced relation to extend in a linear array on a preselected axis on said marking device, mounting a lesser number of marking elements on the marking device than the maximum number of characters to be imprinted in the linear array on the object, positioning said preselected axis of said marking elements parallel to a longitudinal axis of said marking device, moving said marking device relative to the object to be marked to linearly move said marking elements to preselected positions along a first axis for marking in a first direction parallel to a longitudinal axis of said marking device, aligning the preselected axis of said marking elements with the first axis for marking, providing each of said marking elements with an actuator to move said marking element to strike the object to be marked, moving said actuator with said respective marking element to the preselected positions for marking the object, selectively actuating said marking elements mounted on said marking device to strike the object and simultaneously mark portions of each of the characters of said preselected array of characters on the object, incrementally moving said marking elements to selected positions along said first axis for marking to permit marking more characters on said first axis on the fixed object than marking elements present on said marking device, and while holding said object fixed moving said marking device to a second axis for marking parallel to said first axis and selectively actuating said marking elements while incrementally moving said marking device to selected positions along said second axis for marking to simultaneously mark other portions of said preselected array of characters on the object.

8. A method for simultaneously marking a preselected array of characters on an object as set forth in claim 7 which includes, maintaining said plurality of marking elements a preselected distance apart while said marking elements simultaneously mark portions of each character in said preselected array of characters on the object.

9. A method for simultaneously marking a preselected array of characters on an object as set forth in claim 8 which includes, moving said marking device along said second axis in an opposite direction to the movement of said marking device along said first axis in said first direction while said plurality of marking elements simultaneously mark portions of each character of said preselected array of characters on said object.

10. A method for simultaneously marking a preselected array of characters on an object as set forth in claim 9 which includes, moving said marking device in a raster pattern a preselected distance along successive parallel axes and advancing said marking device incrementally from one parallel axis to the next successive parallel axis while said plurality of marking elements simultaneously mark portions of each of said characters of said preselected array of characters on the object.

* * * * *